US006646958B1

(12) United States Patent
Geiger

(10) Patent No.: US 6,646,958 B1
(45) Date of Patent: Nov. 11, 2003

(54) GOLFER'S WATCH

(75) Inventor: Hervé Geiger, La Neuveville (CH)

(73) Assignee: Montres Antima S.A., Bienne (CH)

( * ) Notice: Subject to any disclaimer, the term of this patent is extended or adjusted under 35 U.S.C. 154(b) by 0 days.

(21) Appl. No.: 09/936,241

(22) PCT Filed: Mar. 7, 2000

(86) PCT No.: PCT/IB00/00231

§ 371 (c)(1),
(2), (4) Date: Sep. 7, 2001

(87) PCT Pub. No.: WO00/54116

PCT Pub. Date: Sep. 14, 2000

(30) Foreign Application Priority Data

Mar. 8, 1999 (CH) ..... 424/99

(51) Int. Cl.[7] ..... G04B 47/00
(52) U.S. Cl. ..... 368/10
(58) Field of Search ..... 368/10

(56) References Cited

U.S. PATENT DOCUMENTS 4,864,592 A * 9/1989 Lee ..... 340/323 R
4,922,850 A * 5/1990 Conley ..... 116/222
5,550,884 A * 8/1996 Berney ..... 377/5
6,125,081 A * 9/2000 Flynn ..... 368/10
6,330,520 B1 * 12/2001 Dziulko et al. ..... 368/10

FOREIGN PATENT DOCUMENTS

CH 663 318 12/1987

* cited by examiner

*Primary Examiner*—David Martin
*Assistant Examiner*—Michael L. Lindinger
(74) *Attorney, Agent, or Firm*—McGlew and Tuttle, P.C.

(57) ABSTRACT

A golfer's watch mechanism includes a first mechanical counter for counting a number of strokes of a golf hole. The first mechanical counter has a mechanical display and a mechanical drive for advancing the count and for positioning the mechanical display based on the count. A second mechanical counter counts a total number of strokes played for a series of golf holes. The second mechanical counter includes a second counter mechanical display and a second counter mechanical drive for positioning the mechanical display based on the total number of strokes. A mechanical control is provided with first and second push-buttons connected to the mechanical drive of said first mechanical counter and connected to the second counter mechanical drive. The mechanical control increments and decrements the first mechanical counter and resets the first mechanical counter and resets the second mechanical counter to zero and increments the second mechanical counter when the first mechanical counter is reset to zero.

5 Claims, 3 Drawing Sheets

GOLFER'S WATCH

BRIEF SUMMARY OF THE INVENTION

The present invention concerns a golfer's watch, of the type including at least:

first and second counters, intended to count respectively the number of strokes necessary for the golfer to putt his ball into a hole of the course and the total number of strokes played, and each including display means, means for driving and means for positioning the display means, control means, connected to said drive means and arranged to enable the user to increment the counters and to reset them to zero.

Golfer's watches provided with several counters are known, for example from Swiss Patent No. 663,318. Such watches enable the golfer to regularly follow the progress of the round, with the indication of the results relating to the hole being played and the sum of the strokes played in the preceding holes.

It happens, relatively often, that an error in handling the control means, generally a push-button, leads to an erroneous result being displayed. In such case, the golfer resets this counter to zero and increments it to the correct result, or he does not count the next stroke. In the first case, the golfer has to perform a relatively long manipulation, in the second case, he has to remember not to count the next stroke. In both cases, his concentration and pleasure are reduced. This drawback makes the use of the watch tedious and results in a lack of interest in this type of product by the player, who then prefers to count the strokes by other means.

The invention proposes to overcome this drawback. This object is achieved owing to the fact that, in the watch according to the invention, the control means are arranged to also enable the user to decrement, at least, the first counter.

In a first embodiment, the control means are arranged to increment and decrement the first counter and to increment the second counter when the first counter is reset to zero. In this case, the second counter displays the number of strokes played as far as the last hole reached. Its total is only modified when the following hole is reached. The first counter is reset to zero after the stored number is added to the content of the second counter. In this embodiment, correction by decrementing only acts on the first counter.

This embodiment uses control means which include first and second push-buttons for respectively incrementing and decrementing the first counter, a third push-button for resetting the first counter to zero and for incrementing the second counter by as many strokes as the first counter counted prior to being reset to zero and a fourth push-button for controlling the resetting to zero of the second counter.

In a second embodiment, the control means are arranged to drive the first and second counters simultaneously during incrementing and decrementing. Consequently, the second counter displays the number of strokes played, including those of the last hole. Also, when a correction has to be made, it has to be made to both counters.

In this embodiment, it is advantageous for the control means to include a first push-button for incrementing the two counters, a second push-button for decrementing them, a third push-button for resetting the first counter to zero and a fourth push-button for resetting the first and second counters to zero.

Advantageously, the watch further includes a dial provided with apertures and the display means of the first counter are formed of a disc arranged behind the dial and provided with at least one portion forming a contrast with the latter, to display the number of strokes by means of dots visible through the apertures.

BRIEF DESCRIPTION OF THE DRAWINGS

Other advantages and features of the invention will appear from the following description, made with reference to the annexed drawing, in which.

DETAILED DESCRIPTION

In the following description, the term "o'clock " preceded by a number is used to designate a position on the watch dial, this position corresponding to that occupied by an hour hand at the time considered.

Figure 1:
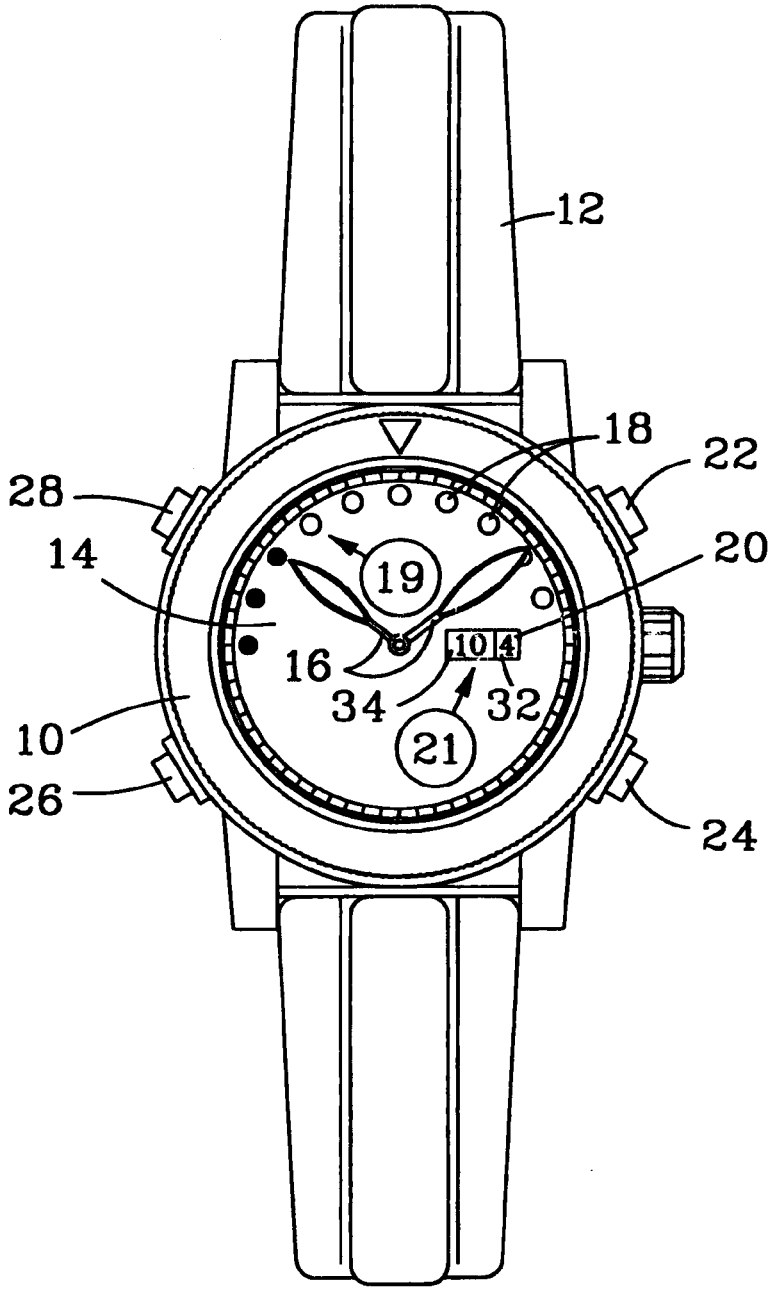
FIG. 1 shows an external view of the watch according to the invention.

FIG. 1 shows a watch according to the invention, including a case 10 and a wristband 12. Case 10 defines a housing in which is fixed a watch movement carrying a dial 14 and hands 16 intended to display the hours and the minutes.

Dial 14 is provided with ten round apertures 18, arranged in the arc of a circle at the periphery of the dial, between "9 o'clock " and "2.30" approximately and forming a first counter 19, and a rectangular opening 20 arranged at "3 o'clock " and defining a second counter 21. Counters 19 and 21 allow respectively the number of strokes necessary to reach a given hole and the total strokes played to be displayed.

The watch is controlled by means of four push-buttons 22, 24, 26 and 28, respectively arranged at 2, 4, 8 and "10 o'clock".

Figure 2:
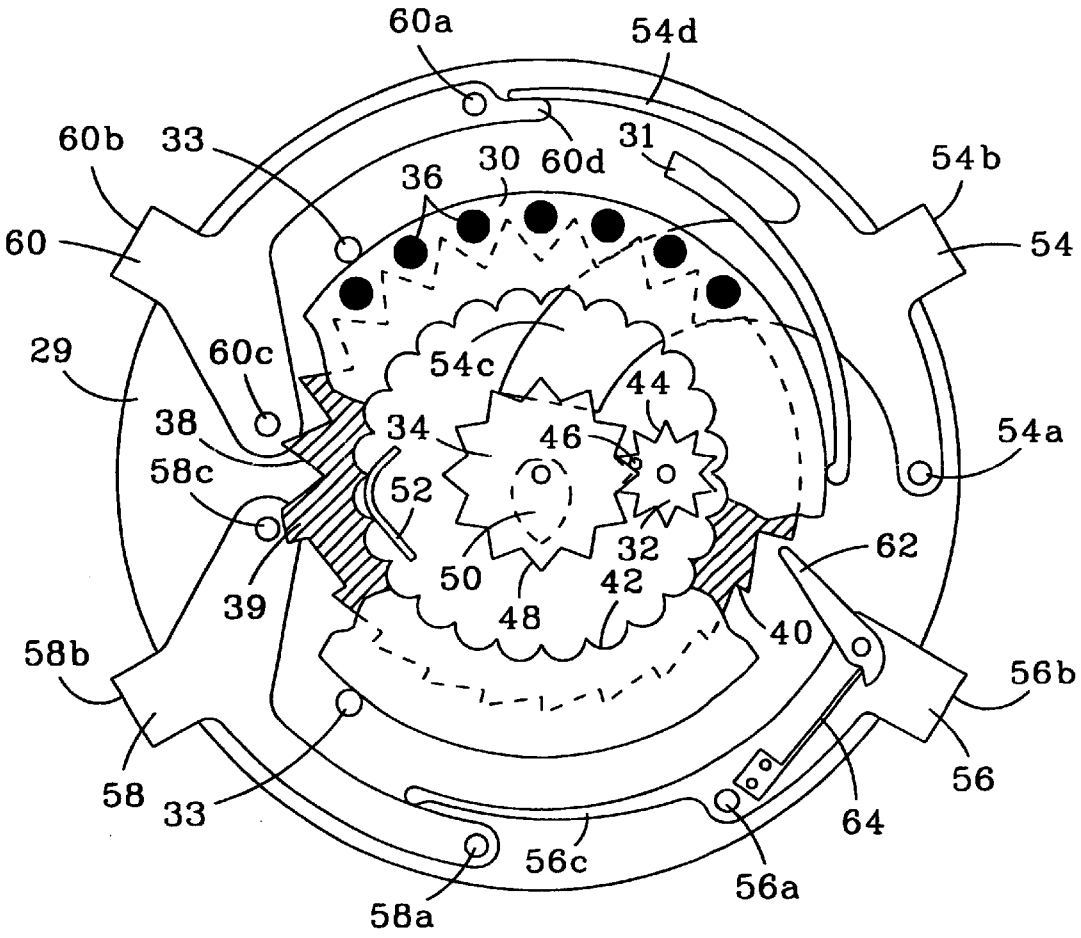
FIGS. 2 and 3 illustrate two embodiments of a mechanism enabling the watch according to the invention to be controlled.

As can be seen in FIG. 2, the movement includes a plate 29 acting as a support for various components.

At the back of dial 14 there are three discs 30, 32 and 34, mounted so as to pivot on plate 29. Disc 30 is visible in FIG, 2 while discs 32 and 34 are only visible in FIG. 1, through opening 20.

First disc 30 is arranged on plate 29 and positioned by means of a spring 31 and two pins 33. Spring 31, fixed onto plate 29, exerts a radial force in the "3 o'clock"–"9 o'clock " direction. Pins 33 are driven into the plate respectively at "7.30" and "10.30".

In the rest position, this disc 30 is concentric with hands 16. It carries, on its face arranged under the dial, ten dots 36 whose appearance contrasts with the background of dial 14 and which are arranged so that they may be visible, in whole or in part, through apertures 18. The disc allows the number of strokes necessary to reach a given hole to be displayed.

Disc 30 is provided with two outer toothings, a first 38 in the shape of an isosceles triangle and a second 40 which is serrated, both including ten teeth. At each end of toothing 38 there is a stop 39 the function of which will be specified hereinafter. It is also provided with an inner toothing 42. These three toothings have the same angular pitch.

The second disc 32 is off-center and arranged at "3 o'clock ". It carries, on its face under the dial, the figures from 0 to 9, oriented tangential to its periphery and appearing sequentially in opening 20. This disc 32 assures the display of the units of adding counter 21. Its lower face carries a star wheel 44 with ten teeth which are arranged so as to be able to mesh or not mesh with inner toothing 42, depending upon the position of disc 30, as will be explained hereinafter. The plate of wheel 44 carries a finger 46, which is advantageously resilient radially, the function of which will be explained hereinafter. Disc 32 is advantageously provided with a heart-piece, which has not been shown in the drawing, like that of disc 34 which will be described hereinafter.

The third disc 34 is also concentric with hands 16. It carries, on its face under the dial, the numbers from 0 to 11 which appear in sequence in opening 20, to the left of the figure carried by disc 32. It permits the display of the tens and hundreds of adding counter 21. It is provided with a star wheel 48 with twelve teeth, arranged at the same height and on the path of finger 46, and a heart-piece 50 such as those fitted to chronographs.

The three discs 30, 32 and 34 are positioned by means of jumper springs. In order to avoid overloading the drawing, only one of them has been partially shown at 52, which cooperates with toothing 42.

The discs are driven by means of four levers 54, 56, 58 and 60, arranged respectively facing push-buttons 22, 24, 26 and 28, at the periphery of plate 29. Each of them is mounted so as to pivot on the plate at a and includes a bent portion at b arranged in proximity to the push-button with which it cooperates.

Lever 54 is intended to reset counter 21 to zero. It includes two hammers, only one of which is shown at 54*c*, arranged so as to cooperate with heart-piece 50, and a resilient arm 54*d* abutting against lever 60 and generating a return torque tending to return lever 54 to the rest position when pressure is applied by means of push-button 22. The second hammer is intended to cooperate with the heart-piece carried by disc 32.

The function of lever 56 is to reset counter 19 to zero. It is provided with a resilient arm 56*c* abutting against lever 58 and arranged so as to generate a torque tending to return lever 56 to the rest position when pressure is exerted by means of push-button 24. It carries an articulated finger 62 and a spring 64 arranged so that an application of pressure onto push-button 24 causes finger 62 to mesh with toothing 40, to allow the disc to move in the anti-clockwise direction.

Lever 58 is intended to increment counter 19. It includes a pin 58*c*, which is arranged on the opposite side to pivoting point 58*a* and which extends into the thickness of disc 30. It is more precisely placed so that any action on push-button 26 causes pin 58*c* to abut against the flank of a tooth of toothing 38, driving disc 30 in rotation in the clockwise direction. Moreover, resilient arm 56c, which abuts against the body of lever 58 between the pivoting point and pin 58*c*, generates a torque tending to return lever 58 to the rest position when pressure is exerted by means of push-button 26.

Lever 60 has a comparable structure to that of lever 58, also with a pin 60*c*, arranged so as to cooperate with the other flank of the teeth of toothing 38, so that an application of pressure on push-button 28 drives disc 30 in the anti-clockwise direction. Moreover, resilient arm 54d, which abuts on the exterior against a finger 60*d* extending lever 60 beyond its pivoting point 60a, generates a torque tending to return lever 60 to the rest position when pressure is exerted by means of push-button 28.

The device described operates as follows.

At the beginning, the two counters 19 and 21 are at zero. After the golfer has played his first stroke, he exerts pressure on push-button 26, which drives lever 58. Pin 58*c* acts on toothing 38 and causes disc 30 to jump through one step in the clockwise direction. A dot 36 then appears in one of apertures 18.

During this operation, disc 30 moves on the plate in the "9 o'clock"–"3o'clock" direction, spring 31 deforming, so that inner toothing 42 does not mesh with toothing 44. In other words, the state of counter 21 is not modified. While the golfer is playing the same hole, at each stroke, he applies pressure once to push-button 26, which increments counter 19 by one step.

When the ball has reached its target, the golfer changes hole. He then resets counter 19 to zero by successive applications of pressure on push-button 24. In this case, disc 30 remains concentric with the hands, so that inner toothing 42 meshes with toothing 44. The second disc is thus driven in rotation, by as many steps as disc 30 displayed dots. Consequently, by resetting counter 19 to zero, counter 21 is incremented by as many dots as counter 19 counted.

The golfer can then start counting strokes again for the second hole, by successive applications of pressure on push-button 26 and so on until the last hole.

If, on the way, the golfer has made a counting error, by pressing one time too many on push-button 26, he can correct his error by pressing on push-button 28, which will decrement counter 19, without modifying the content of counter 21.

At the end of the round, counter 19 is reset to zero a last time. Consequently, counter 21 indicates the total number of strokes played for the whole of the round.

Before beginning a new game, the golfer has to reset counter 21 to zero. One application of pressure on push-button 22 has the effect of bringing the hammers of lever 54 against heart-pieces 50 of discs 32 and 34, so as to return them to zero. The two wheels can move freely one facing the other, because they are connected to each other by means of resilient finger 46.

It should be noted that, in the position shown in FIG. 2, disc 30 is arranged so that all of dots 36 appear in apertures 18. Consequently, counter 19 is saturated. This is why, if the golfer wanted to add another dot by pressing on push-button 26, he could not do so, since pin 58c would abut against stop 39.

Figure 3:
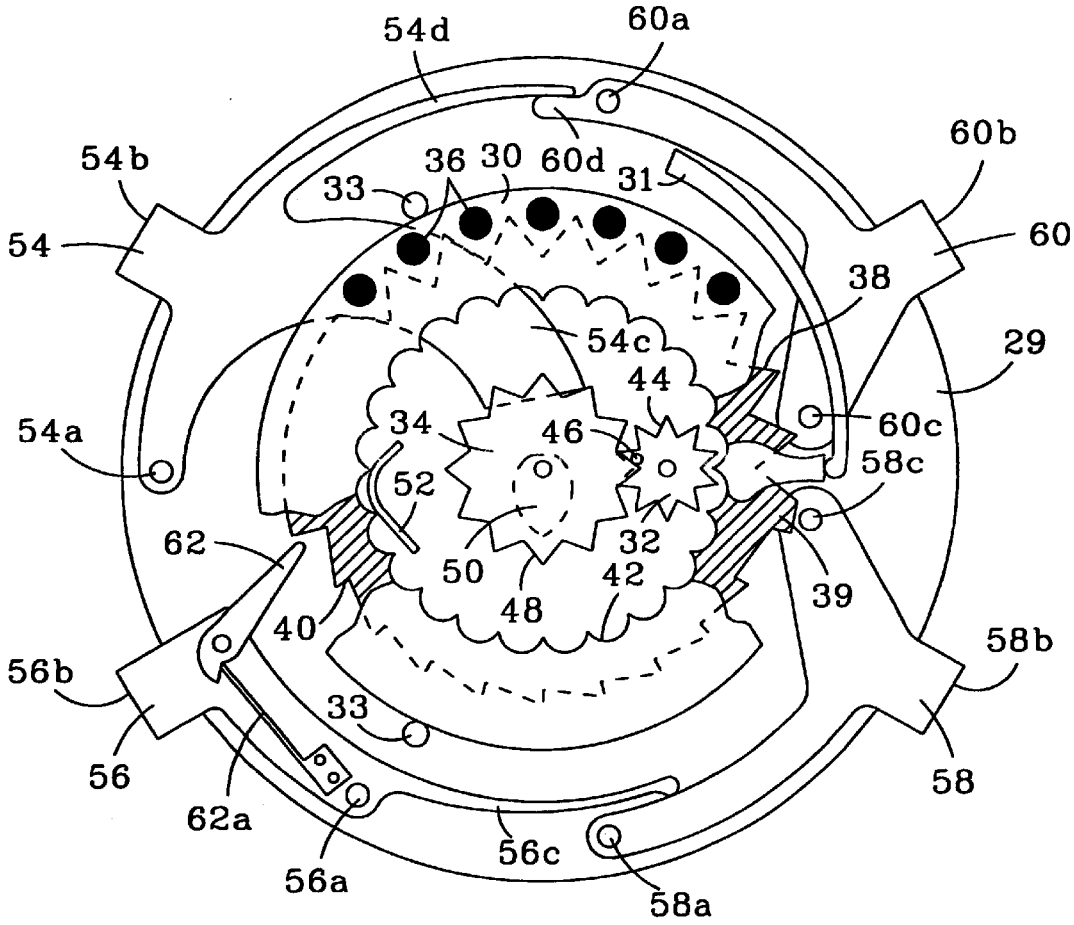

The mechanism shown in FIG. 3 is similar to that of FIG. 2 with the exception of levers 54, 56, 58 and 60 and disc 30, which are arranged symmetrically with respect to a plane passing through "6 o'clock" and midday.

In this configuration, push-button 22 acts on lever 60 whose function is still to decrement disc 30. Push-button 24 controls lever 58, to decrement counter 19. Push-button 26 is arranged to cooperate with lever 56, which resets counter 19 to zero. Finally, push-button 28 cooperates with lever 54 to reset counter 21 to zero.

The effect of this modification is that an action on push-buttons 58 and 60 simultaneously drives discs 30 and 32. Indeed, during this action, disc 30 remains concentric with the hands, so that toothing 42 meshes with toothing 44. Thus, the two counters 19 and 21 are incremented and decremented at the same time.

When the units counter is reset to zero, by means of lever 56, controlled by push-button 26, disc 30 moves laterally along the "9 o'clock "–"3 o'clock " direction, so that toothing 42 is not meshed with toothing 44. In other words, resetting counter 19 to zero does not modify the state of counter 21.

It should be emphasized again, that with this embodiment, dots 36 appear in apertures 18 from "2.30" in the anti-clockwise direction.

It is clear that the watch according to the invention may the subject of numerous other variants, without thereby departing from the scope of the invention. Amongst these, counter 19 could also be achieved by digital means. This would of course result in a different arrangement of the different components of the watch.

It also goes without saying that the means for driving the display means could be achieved in numerous ways, without this changing the principles listed above.

What is claimed is:

1. A golfer's watch mechanism, comprising:

first mechanical counter and a second mechanical counter, intended to count respectively the number of strokes necessary for the golfer to putt his ball into a hole of the course and the total number of strokes played, and each including a mechanical display, and a mechanical drive and for positioning the mechanical display, a mechanical control means connected to said mechanical drive and arranged to enable the user to each increment the first mechanical counter and the second mechanical counter and to reset the first mechanical counter and the second mechanical counter to zero, wherein said mechanical control means is arranged to further enable the user to decrement at least said fist mechanical counter.

2. A watch according to claim 1, wherein said mechanical control means is arranged to increment and decrement the first mechanical counter and to increment the second mechanical counter when the first mechanical counter is reset to zero.

3. A watch according to claim 1, wherein said mechanical control means is arranged to drive the first mechanical counter and the second mechanical counter simultaneously during incrementing and decrementing.

4. A watch according to claim 1, further including a dial provided with apertures and wherein the display means of the first mechanical counter are formed of a disc arranged behind said dial and provided with at least one portion contrasting with said dial, to display the number of strokes by means of dots visible through said apertures.

5. A watch according to claim 3, further including a dial provided with apertures and wherein the mechanical display of the first counter is formed of a disc arranged behind said dial and provided with at least one portion contrasting with said dial, to display the number of strokes by means of dots visible through said apertures.

* * * * *